US006384805B1

(12) United States Patent
Takada

(10) Patent No.: US 6,384,805 B1
(45) Date of Patent: May 7, 2002

(54) OUTPUT LEVEL AVERAGING CIRCUIT FOR LCD SOURCE DRIVER

(75) Inventor: Shigeho Takada, Shiga-ken (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/413,157

(22) Filed: Oct. 6, 1999

(30) Foreign Application Priority Data

Oct. 6, 1998 (JP) ..... 10-283896

(51) Int. Cl.[7] ..... G09G 3/36

(52) U.S. Cl. ..... 345/87; 345/95; 345/98; 345/100

(58) Field of Search ..... 345/95, 100, 98, 345/87

(56) References Cited

U.S. PATENT DOCUMENTS 5,619,221 A * 4/1997 Hirai et al. ..... 345/58
5,744,986 A * 4/1998 Yamada et al. ..... 327/95
5,812,106 A * 9/1998 Hughes ..... 345/90
5,926,162 A * 7/1999 Wood et al. ..... 345/101
6,222,516 B1 * 4/2001 Oda et al. ..... 345/94

FOREIGN PATENT DOCUMENTS

JP 1-281497 11/1989
JP 9-237068 9/1997

* cited by examiner

*Primary Examiner*—Chanh Nguyen
*Assistant Examiner*—Fritz Alphonse
(74) *Attorney, Agent, or Firm*—Scully, Scott, Murphy & Presser; Marian Underweiser

(57) ABSTRACT

An object of the present invention is to improve display quality of the LCD device and yield of source-driver chips by adding a slight circuit, and averaging and evening out output levels of LCD source drivers.

An output-level averaging circuit for an LCD source driver LCn which comprises an average-value-detecting means (22, S1*n*) for detecting an average value Ave of output signals O (O1, O2, . . . , On, . . . ) of output drivers D(D1, D2, . . . , Dn, . . . ), an electric-potential-difference detecting means (Cn, S2*n*, or S3*n*) for detecting electric potential difference between the detected average value Ave and output levels O of the output driver D, and a feedback means (S4*n*) for feeding back detected electric potential difference by adding it to output signals O of the output driver D, and which is set to the output portion of the source driver SDn.

5 Claims, 3 Drawing Sheets

OUTPUT LEVEL AVERAGING CIRCUIT FOR LCD SOURCE DRIVER

BACKGROUND OF THE INVENTION

1. Technical Field

The present invention relates to a source driver for driving display portion of a liquid crystal display (hereinafter referred to as LCD) device, more particularly, relates to an averaging circuit for averaging output levels of a source driver.

2. Prior Art

As an example of a source driver for an LCD device, a block diagram of a source driver SDn corresponding to an n-th (wherein n represents a positive integer) output port On is shown in FIG. 2. In FIG. 2, M1n represents a portion corresponding to the n-th output port On in a memory M1 wherein data corresponding to display is stored. The reference numeral 14 represents a data bus for transmitting data corresponding to display to the memory M1 (M11, M12, . . . , M1n, . . . ). AR represents an address register for specifying memory for storing data corresponding to display. Accordingly, when the address register AR specifies the memory M1n, data is transmitted to the memory M1n by the data-bus 14. The address register AR may often comprises a shift register, however component of the address register AR is not limited to a shift register.

When all the data corresponding to display are stored in the memory M1 (M11, M12 . . . , M1n, . . . ) and the time to display data comes, data in the memory M1n is shifted to the memory M2n. The memory M2n represents a portion corresponding to the n-th output port On in the memory M2 wherein data corresponding to display is transmitted to a D/A converter T after said data is received from the memory M1. Tn represents a portion corresponding to the n-th output port On of the D/A converter T, which converts digital data received from the memory M2 into analogue data and then transmits the analogue data to an output driver D. Dn represents a portion corresponding to the n-th output port On of the output driver D comprising an operation amplifier wherein an output port of the D/A converter T is connected to a positive input port and an output signal O is transmitted to an output line 12 while being fed back to its own negative input port.

In such a conventional art described above, unevenness and defects of source driver chips generated in the manufacturing process may often cause output levels to become uneven, as shown in FIG. 3(*a*) and (*b*). FIG. 3(*a*) shows unevenness of n-th output levels, in which X and O respectively indicate a slightly higher and a slightly shorter output level than the other output levels, when all the output signals are expected to be on the same level. If all the output signals are not on the same level, a bright line corresponding to X or dark line corresponding to O is displayed longitudinally on the LCD display, and thus display quality is degraded to a great extent.

As shown in FIG. 3(*b*), output level is slightly different depending on each output terminal, because properties are slightly different depending on each source driver chip. If output level is slightly different depending on each output terminal, the left part and the right part of the display screen are slightly different in brightness. Thus, display quality is degraded. Even if substantially ideal output levels are secured inside of a chip, since a large number of source driver chips are used in each LCD device, output levels may be different between chips. Because of this, brightness may often be different between interfaces displayed by individual chips. Thus, display quality is also degraded in this case.

As a result of our preliminary investigation of preceding arts prior to filing an application for a patent related to the present invention, the Japanese Laid Open Patent Publications No. 1-281497 and No. 9-237068 were detected. The Laid-Open Japanese Patent Publication No. 1-281497 discloses an LCD device comprising an average-level-detecting means for detecting an average level of display signals transmitted from external sources. This LCD device corrects at least either of DC-level or amplitude of display signals in accordance with output signals of the average-level detecting means in order to be adopted to standardized penetrating power characteristic prescribed for voltage of the LCD panel. The above-cited art aims to achieve display performance excellent in linearity and contrast by this correction.

However, the above-cited invention relates to the correction which is executed in a stage prior to transmitting data into a source driver (which corresponds to the reference numerals 17, or 15 and 17 in the above-cited Japanese Patent Publication), and yet, data R, G, B, are analogue signals. Further, different circuits 19, 20, and 21 are used respectively for data R, G, and B to correct display signals. Concretely, data R, G, and B are corrected respectively by the different circuits 19, 20, and 21. For this reason, it might be possible to correct display signal into colors different from what is intended.

The Laid-Open Japanese Patent Publication No. 9-237068 discloses a picture display device comprising a signal-level-detecting means for detecting respective level of data signals separately and a signal-level-control means for controlling signal levels of predetermined data signals of said data signals based on detected outputs of the signal-level detecting means so that the levels of data signals can coincide with predetermined data signals. This picture display device aims to suppress the generation of display unevenness caused by the difference properties of the channel.

However, the above-cited invention relates to correction which is executed in a stage prior to transmitting data into a source driver (corresponding to the reference numerals 12 and 13 shown in the above-cited Japanese Patent Publication), and yet, data R, G, B are analogue signals. Further, neither error of added integration circuit 57 and comparison circuit 58 nor an adverse effect on an analogue switch 12 by error has been taken into consideration. Consequently, these errors may cause errors in properties of a channel.

An object of the present invention is to improve display quality of the LCD device and yield of source-driver chips by adding a slight circuit, and averaging and evening out output levels of LCD source drivers.

SUMMARY OF THE INVENTION

The present invention is directed to an output-level averaging circuit for a LCD source driver (LCn) comprising an average-value-detecting means (22, S1*n*) for detecting an average value Ave of output signals (O1, O2, . . . , On, . . . ) of output drivers (D1, D2, . . . , Dn, . . . ), an electric-potential-difference detecting means (Cn, S2*n*, or S3*n*) for detecting electric potential difference between the detected average value Ave and output levels of the output driver D, and a feedback means (S4*n*) for feeding back detected electric potential difference by adding it to the output driver D.

BRIEF DESCRIPTION OF THE DRAWINGS

Preferred embodiments of the present invention will now be described, by way of example only, with reference to the accompanying drawings in which.

DETAILED DESCRIPTION OF THE PREFERRED EMBODIMENTS OF THE INVENTION

Figure 2:
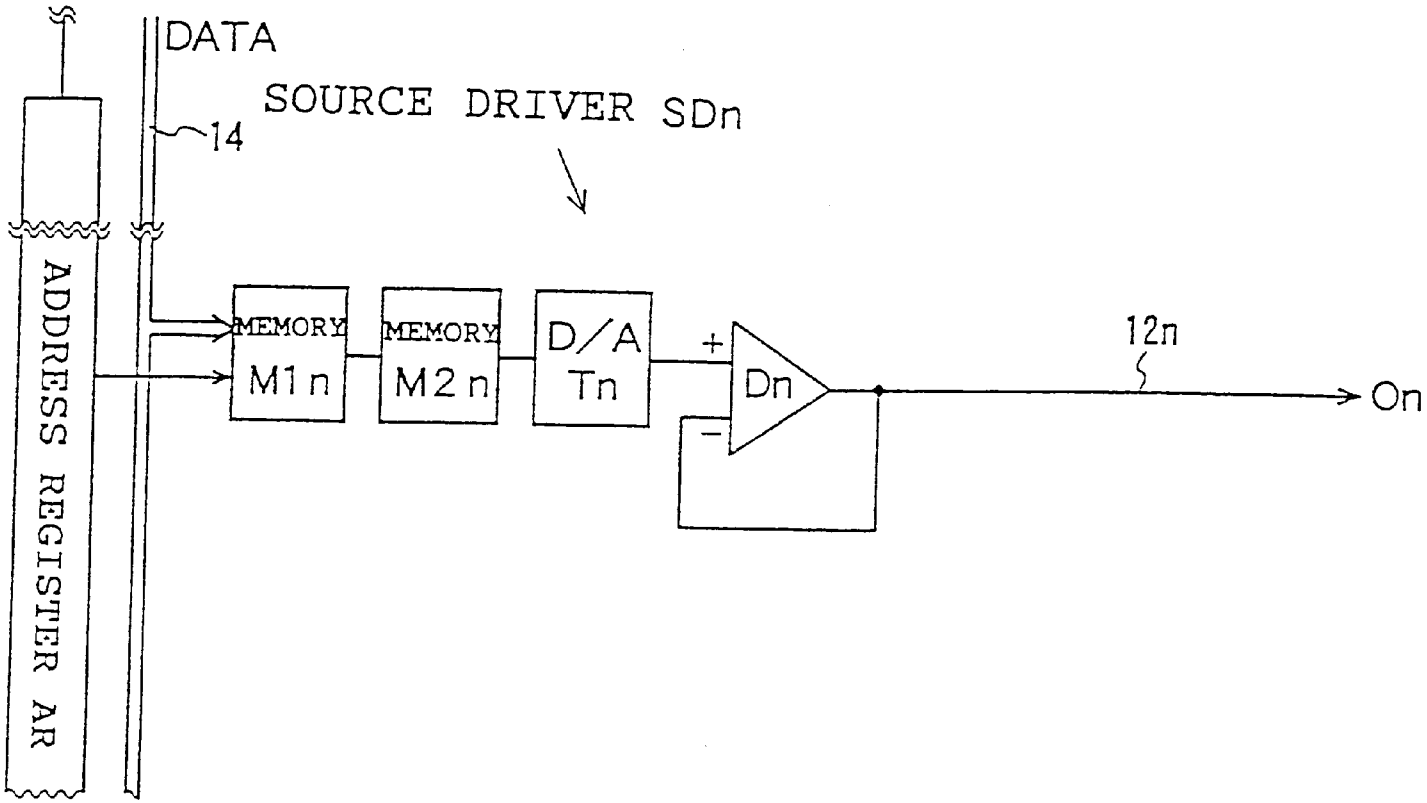
FIG. 2 is an enlarged circuit diagram showing n-th output port of a conventional source driver for an LCD device.
Figure 3:
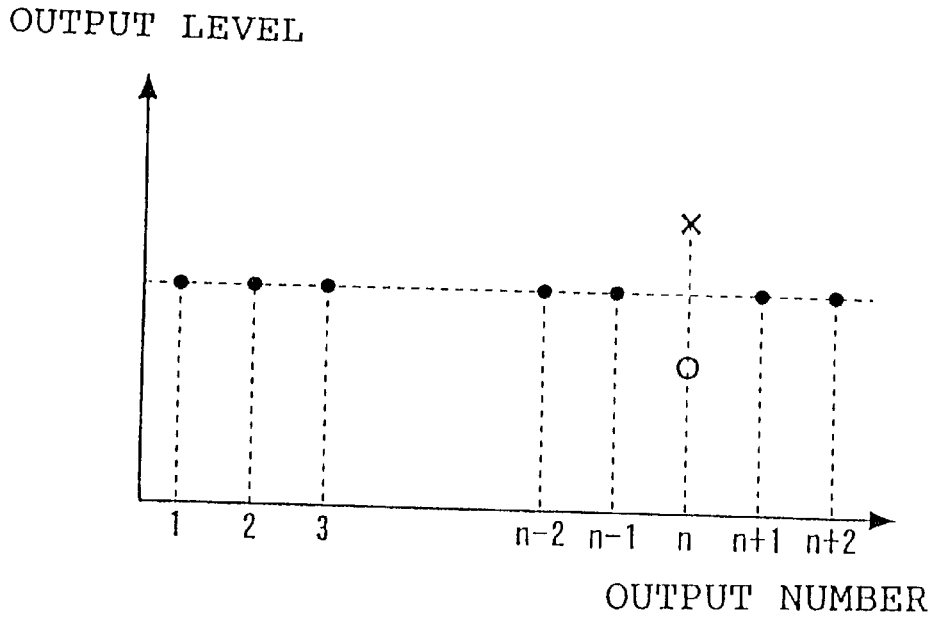
FIG. 3 is a graph showing output level of each output port of a conventional source driver for an LCD device.
Figure 3:
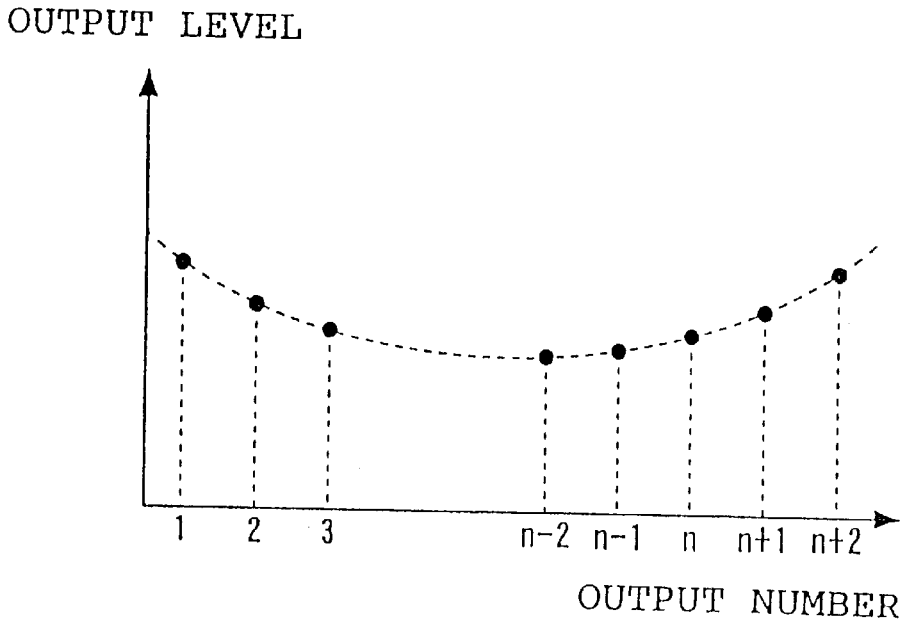

The preferred embodiments of the present invention will now be described with reference to FIGS. 1 to 3 of the drawings.

Figure 1:
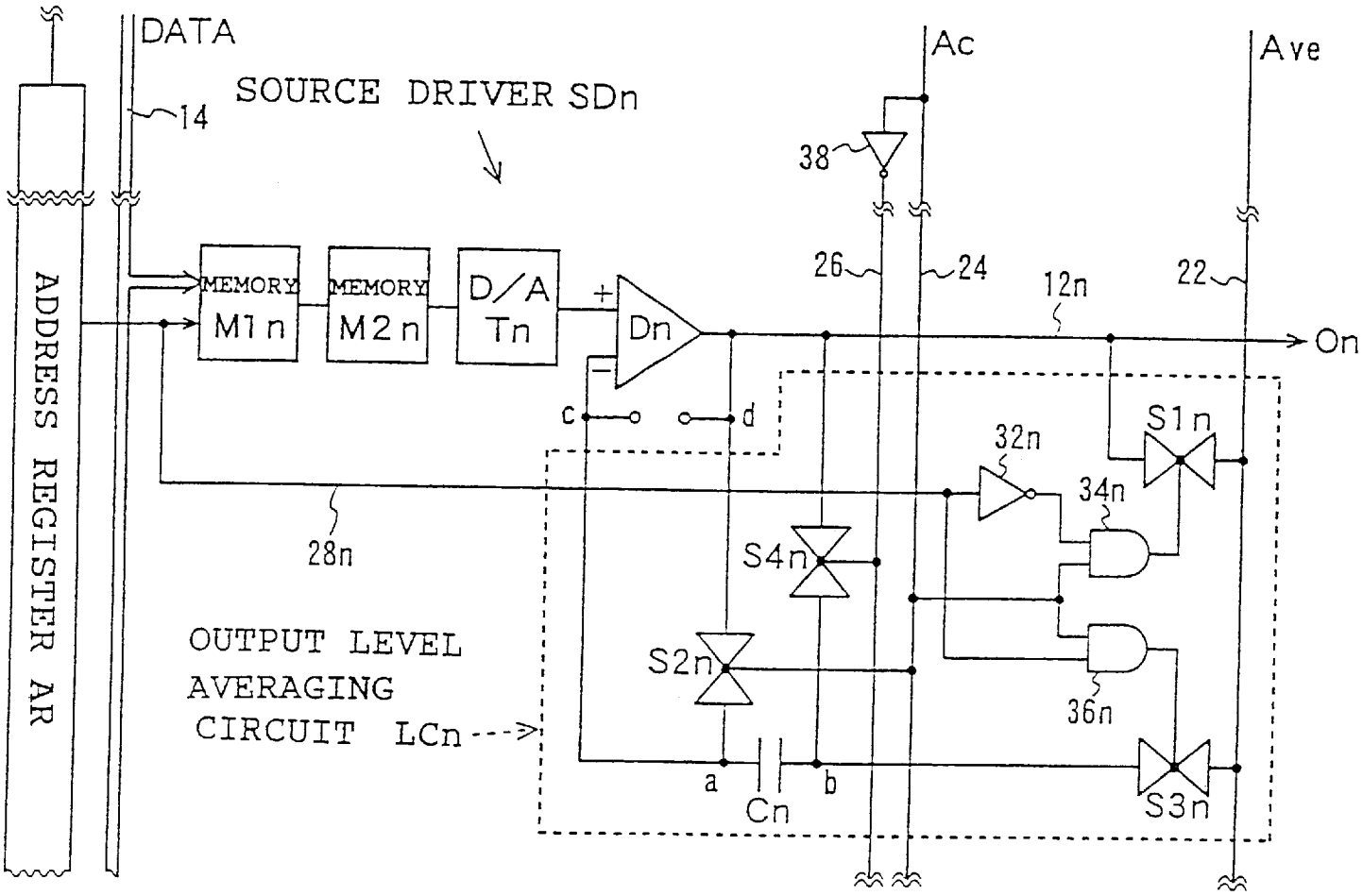
FIG. 1 is an enlarged circuit diagram showing n-th output port of a source driver for an LCD device according to the present invention.

FIG. 1 shows a circuit diagram of a source driver for an LCD device incorporating an output-level averaging circuit in its output portion. This circuit diagram represents an averaging circuit LCn incorporated in a source driver SDn corresponding to an n-th output port On. By connecting substantially all the output ports (O1, O2, . . . , On, . . . ) to an averaging wire 22, an average value Ave of substantially all the output ports is obtained. The external terminal of a source driver connected to the averaging wire 22 is connected with an external terminal of adjoining source driver chips when it is implemented in an LCD device, and thus uneven factors between chips are absorbed. (preferably, terminals are provided at both ends of chips.)

The averaging wire 22 is connected to an output line 12*n* by the switch S1*n*. ON/OFF (closing/opening) operation of the switch S1*n* is executed by a control signal Ac transmitted from a control signal line 24 and a memory-specifying signal transmitted from a memory-specifying signal line 28*n*. Concretely, ON/OFF switching operation is controlled by AND (evaluated by the AND circuit 34*n*) of a signal generated by inversion of the memory-specifying signal 28*n* (inverted by NOT circuit 32*n*) and a control signal Ac. The control signal Ac is a signal for controlling timing of respective process to average output levels. The memory-specifying signal 28*n* is a signal for showing that the address register AR specifies a memory (M1*n* shown in FIG. 1). The switch S1*n* is turned ON and the output line 12*n* is connected to the averaging wire 22, only when the memory M1*n* is not specified by the address register AR (while the memory-specifying signal remains L level) and the control signal Ac is ON (at H level).

Cn represents a capacitor for maintaining electric potential difference between the output level of the output port On and the average value Ave. The terminal b of the capacitor Cn is connected to the averaging wire 22 by the switch S3*n*. ON/OFF (closing/opening) operation of the switch S3*n* is controlled by AND (evaluated by the AND circuit 36*n*) of the memory-specifying signal 28*n* and the control signal Ac. The second switch S3*n* is turned ON and the terminal b of the capacitor Cn is connected to the averaging wire 22, only when the memory M1*n* is specified by the address register AR (memory-specifying signal remains H level) and the control signal Ac remains ON (H level).

The terminal a of the capacitor Cn is connected to the output line 12*n* by the switch S2*n*. ON/OFF (closing/opening) operation of the switch S2*n* is controlled by the control signal Ac transmitted from the control signal line 24. When the control signal Ac is ON (H level), the switch S2*n* is turned ON and the terminal a of the capacitor Cn is connected to the output line 12*n*. In other words, when the control signal Ac and the memory-specifying signal is ON, electric potential difference between the output level of the output port On and the average value Ave is added to the capacitor Cn.

The terminal b of the capacitor Cn is connected to the output line 12*n* by the switch S4*n*. ON/OFF (closing/opening) operation of the switch S4*n* is controlled by the inverted signal of the control signal Ac (inverted by NOT circuit 38) transmitted from the control signal line 26. Accordingly, when the control signal Ac is OFF (L level), the switch S4*n* is turned ON and the terminal b of the capacitor Cn is connected to the output line 12*n*. Further, when the control signal Ac is OFF, other switches S1*n*, S2*n*, and S3*n* are turned OFF and the terminal a of the capacitor Cn is connected to a negative input port of the output driver Dn. When the control signal Ac is OFF, voltage added with electric potential difference held by the capacitor Cn at the output port On is fed back to the output driver Dn.

If the averaging circuit of the present invention is set to the output portion of the source driver for the LCD device according to the present invention, a conventional circuit of an output driver for feeding signal back to itself is constantly held open (See terminals c and d in FIG. 1). Conventionally available address register AR, data-bus 14, memory M1*n*, memory M2*n*, D/A converter Tn, and output driver Dn are used in the present invention.

Next, the operation for averaging output levels by using the output level averaging circuit for the LCD source driver is described below.

First, a certain output level is determined in order to confirm desired averaging effect, and then data corresponding to the output level is stored in all the memories M1 (including M11, M12,. . . , M1*n*,. . . ). Then, at the next timing, when all the data are shifted to the memory M2, the control signal Ac is maintained at H level only for the duration corresponding to a single horizontal display line. If the address register AR specifies n-th output port, memory-specifying signal 28*n* is at the H level and the switch S1*n* is OFF, so that a portion between the n-th output port and the averaging wire 22 is opened. On the contrary, output ports (except n-th output port) which are not specified by the address register AR are connected to the averaging wire 22. For this reason, voltage level Ave of the averaging wire 22 is substantially equivalent to the mean value of all the output levels.

when the control signal Ac and the memory specifying signal 28*n* are at H level, the switch S3*n* is turned ON and the terminal b of the capacitor Cn is connected to the averaging wire 22. Further, since the control signal Ac is at the H level, the switch S2*n* is turned ON, whereas the switch S4*n* is turned OFF, thus the output signal On of the output driver Dn is fed back to its own negative input port and the output port is simultaneously connected to the terminal a of the capacitor Cn. Accordingly, electric potential difference $\Delta V$ between the output level of the output port On of the output driver Dn and voltage Ave of the averaging wire 22 is added to the capacitor Cn. When the n-th output port On is no longer specified by the address register AR, the switch S3*n* is turned OFF and the capacitor Cn retains the electric potential difference $\Delta V$. When the memory-specifying signal 28*n* goes to L level, the switch S1*n* is turned ON and the output line 12*n* is connected to the averaging wire 22.

The control signal Ac thus becomes at the L level in the condition that the electric potential difference $\Delta V$ between the mean value Ave and the output level O is retained by capacitors (C1, C2, . . . , Cn, . . . ) against a single horizontal line, i.e., against all the output signals (O1, O2, . . . , On, . . . ). The switches S1*n*, S2*n*, and S3*n* are turned OFF regardless of the designation by the address register AR, and then only the switch S4*n* is turned ON. Thus the output level On and the electric potential difference ΔV retained by the both terminals of the capacitor Cn is fed back to the output driver Dn. As a result of the feedback operation, output level of the output port On of the output driver Dn is driven in the direction of canceling the electric potential difference ΔV retained by the capacitor Cn and it is stabilized at a certain voltage substantially equivalent to the mean voltage Ave secured by the averaging wire 22.

Accordingly, all the output levels (O1, O2, . . . , On, . . . ) are averaged. Any of the averaged output levels can be selected, however, satisfactory result can be achieved by averaging output levels at a level corresponding to medium brightness. Although averaging operation can be executed at any optional timing, it is preferable that the averaging operation be executed when the single horizontal line is displayed at the uppermost portion, bottom portion, or outside of the display. Averaging frequency may be optionally determined according to retentive capacity of the capacitor C.

By setting the output level averaging circuit for the source driver, defect or unevenness generated in manufacturing process can be corrected, and thus the yield and the display quality can be improved. Since the number of circuits to be added is quite negligible against the whole circuitry, it is expected that a lowering of the yield caused by defect and unevenness of the added circuit will also be slight.

Based on the drawings, preferred embodiments of the output-level averaging circuit for the LCD source driver according to the present invention have been described above, however, the present invention is not limited to the referring to the output-level averaging circuit for the LCD source driver shown by the accompanying drawings. For example, it is also practicable to reduce adverse effects of various noises including switching noise by connecting another capacitor between the averaging wire 22 and ground potential or power-supply line. Such capacitor as cited above may be set to an optional position or provided with distributed capacity along the averaging wire 22.

In the above embodiments, only a single level can be selected to average output levels. Difference between the averaged output level and other output levels is retained by the capacitor Cn, and all the levels required for display are corrected with identical voltages. However, if the number of capacitors is increased, a plurality of output levels are averaged, and the amount can be switchably changed by dividing output levels demanded for display and by selecting a capacitor in correspondence with the division of output levels, further improvement of display quality of the LCD device can be achieved.

A major advantage of the present invention is that an output level averaging circuit for LCD source driver according to the present invention can improve display quality of the LCD device and yield of source-driver chips by adding a slight circuit, and averaging and evening out output levels of LCD source drivers.

While the invention has been particularly shown and described with respect to preferred embodiments thereof, it will be understood by those skilled in the art that the foregoing and other changes in form and details may be made therein without departing from the spirit and scope of the invention.

Having thus described my invention, what I claim as new, and desire to secure by Letters Patent is:

1. An output-level averaging circuit for an LCD source driver, which activates output levels of the source driver which drives a display portion of an LCD device and comprises output drivers for feeding signal back to itself, comprising:

an average-value-detecting means for detecting an average output value of output signals of the output drivers;

an electric-potential-difference detecting means for detecting electric potential difference between the detected average output value and an output level of the source output driver; and a feedback means for feeding back the detected electric potential difference by adding said electric potential difference to the source output driver, whereby said source driver output is stabilized at a voltage equivalent to said detected average output value.

2. The output-level averaging circuit of the LCD source driver according to claim 1, wherein said average-value-detecting means comprises a switch for connecting an output port of said output driver to a common wiring.

3. The output-level averaging circuit of the source driver for a LCD device according to claim 1, wherein said electric-potential-difference detecting means comprises an electric-potential-difference retaining means for retaining electric potential difference, a first switch for connecting the output port of said output driver to said potential-difference retaining means, and a second switch for connecting the output port of said average-value-detecting means to said potential-difference detecting means.

4. The output-level averaging circuit of the LCD source driver according to claim 3, wherein said electric-potential-difference retaining means comprises a capacitor, a first terminal of said capacitor is connected to the first switch, and a second terminal of said capacitor is connected to the second switch.

5. The output-level averaging circuit of the LCD source driver according to claim 4, wherein said feedback means comprises a switch for connecting the output levels of said output driver to the second terminal of said capacitor, the first terminal of said capacitor is connected to said output driver.

* * * * *